US011053683B2

(12) United States Patent
Brown

(10) Patent No.: US 11,053,683 B2
(45) Date of Patent: Jul. 6, 2021

(54) APPARATUS FOR CONTROLLING YIELD PERFORMANCE OF PROPS FOR ROOFS, AND METHODS

(71) Applicant: Christopher J. Brown, Acme, PA (US)

(72) Inventor: Christopher J. Brown, Acme, PA (US)

(73) Assignee: Strata Products Worldwide, LLC, Sandy Springs, GA (US)

( * ) Notice: Subject to any disclaimer, the term of this patent is extended or adjusted under 35 U.S.C. 154(b) by 0 days.

(21) Appl. No.: 16/252,058

(22) Filed: Jan. 18, 2019

(65) Prior Publication Data

US 2019/0226209 A1 Jul. 25, 2019

Related U.S. Application Data

(60) Provisional application No. 62/621,361, filed on Jan. 24, 2018.

(51) Int. Cl.
*E04C 3/36* (2006.01)
*E04C 5/01* (2006.01)

(52) U.S. Cl.
CPC . *E04C 3/36* (2013.01); *E04C 5/01* (2013.01)

(58) Field of Classification Search
CPC ..... E21D 15/02; E21D 15/54; E21D 15/04; E21D 15/12; E21D 15/285; E21D 15/28; E21D 15/483; E04C 5/01; E04C 3/36; E04B 1/26; E04B 2001/2696
USPC ..... 248/200.1, 644, 351, 354.1, 354.2; 405/281, 272, 293, 298, 294, 288, 290; 52/728, 831
See application file for complete search history.

(56) References Cited

U.S. PATENT DOCUMENTS 4,520,980 A * 6/1985 Townsend ..... E21D 15/02 248/351
4,534,531 A * 8/1985 Brown ..... E21D 15/02 248/351
4,915,339 A * 4/1990 Halbich ..... E21D 15/02 248/351
5,308,196 A * 5/1994 Frederick ..... E21D 15/483 248/354.2
5,318,387 A * 6/1994 Pienaar ..... E21D 15/55 248/544
5,427,476 A * 6/1995 Pienaar ..... E21D 15/483 248/357

(Continued)

FOREIGN PATENT DOCUMENTS

EP 0128964 A1 * 12/1984 ..... E21D 15/02
GB 2081340 A * 2/1982 ..... E21D 15/02
GB 2285643 A * 7/1995 ..... E21D 15/02

*Primary Examiner* — Theodore V Adamos
(74) *Attorney, Agent, or Firm* — Ansel M. Schwartz

(57) ABSTRACT

The technology provides increased capability and control over the yield performance of the timber prop, a mine roof support. The new Wedge Prop design includes a cut pattern idealized for the specific wood species used in manufacturing and a set of confinement rings varying in strength due to different failure mechanisms. The cut pattern is based on the diameter of the yellow poplar pole, while the confinement rings consist of multiple types of welds to allow for either wire tensile failure or for weld detachment. The cut pattern can be combined in conjunction with various combinations of confinement rings to allow for precise control over the performance of the Wedge Prop in the Propsetter System.

16 Claims, 12 Drawing Sheets

(56) References Cited

U.S. PATENT DOCUMENTS

| | | | | |
|---|---|---|---|---|
| 5,547,317 | A * | 8/1996 | Howell | E21D 11/006 248/354.1 |
| 5,823,718 | A * | 10/1998 | Du Plessis | E02D 15/02 405/288 |
| 6,612,803 | B1 * | 9/2003 | McCartney | B66F 9/18 294/104 |
| 2004/0240948 | A1 * | 12/2004 | Harbaugh | E21D 15/02 405/288 |
| 2007/0231085 | A1 * | 10/2007 | Skarbovig | E21D 15/483 405/288 |
| 2011/0222970 | A1 * | 9/2011 | Skarbovig | E21D 15/483 405/289 |
| 2011/0262231 | A1 * | 10/2011 | Hussey | E21D 15/483 405/289 |
| 2012/0269585 | A1 * | 10/2012 | Faulkner | E21D 15/483 405/289 |
| 2013/0129426 | A1 * | 5/2013 | Skarbovig | E21D 15/483 405/288 |
| 2013/0336727 | A1 * | 12/2013 | Faulkner | E21D 15/005 405/288 |
| 2016/0061032 | A1 * | 3/2016 | Shook | E21D 15/48 405/288 |

* cited by examiner

APPARATUS FOR CONTROLLING YIELD PERFORMANCE OF PROPS FOR ROOFS, AND METHODS

CROSS-REFERENCE TO RELATED APPLICATIONS

This is a non-provisional of U.S. provisional patent application Ser. No. 62/621,361 filed Jan. 24, 2018, incorporated by reference herein.

FIELD OF THE INVENTION

The present invention relates to a prop for supporting a roof that uses a confinement ring wrapped about wedge cuts in the pole of the prop. (As used herein, references to the "present invention" or "invention" relate to exemplary embodiments and not necessarily to every embodiment encompassed by the appended claims.) More specifically, the present invention relates to a mine prop for supporting a roof that uses a confinement ring wrapped about wedge cuts in the pole of the prop where the confinement ring has a spot weld or a solid weld.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

It has long been recognized in the mining industry that the ability of a roof support to be able to accept ground movement and maintain the integrity of the support capacity is a very useful feature. This is highly applicable to situations found in coal and metal mining where the ore extraction methods result in high vertical and horizontal stress environments with the tendency for closure of the mined openings and access ways. In the past various timber, steel, and cement-based structures have been utilized to provide support in these environments. The mine prop described in U.S. Pat. No. 4,915,339 has found limited success in the mining industry, as it is often lacking the performance capabilities of other competing supports.

BRIEF SUMMARY OF THE INVENTION

The present invention pertains to a prop for supporting a roof. The prop comprises a pole that is positioned vertically relative to ground. The prop comprises a tensioner positioned at a top of the pole in between the pole on the roof to pretension the pole with respect to the roof. The prop comprises a ring wrapped about the pole and welded together so failure of the pole under load from the roof is a function of the weld.

The present invention pertains to a method for supporting a roof. The method comprises the steps of positioning a pole of a prop vertically relative to ground. The prop comprises a ring wrapped about the pole and welded together so failure of the pole under load from the roof is a function of the weld. There is the step of positioning a tensioner at a top of the pole in between the pole on the roof to pretension the pole with respect to the roof.

The present invention pertains to a method for producing a prop for supporting a roof. The method comprises the steps of placing a metal ring about a wooden pole. There is the step of spot welding the ring in place about the pole.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1A:
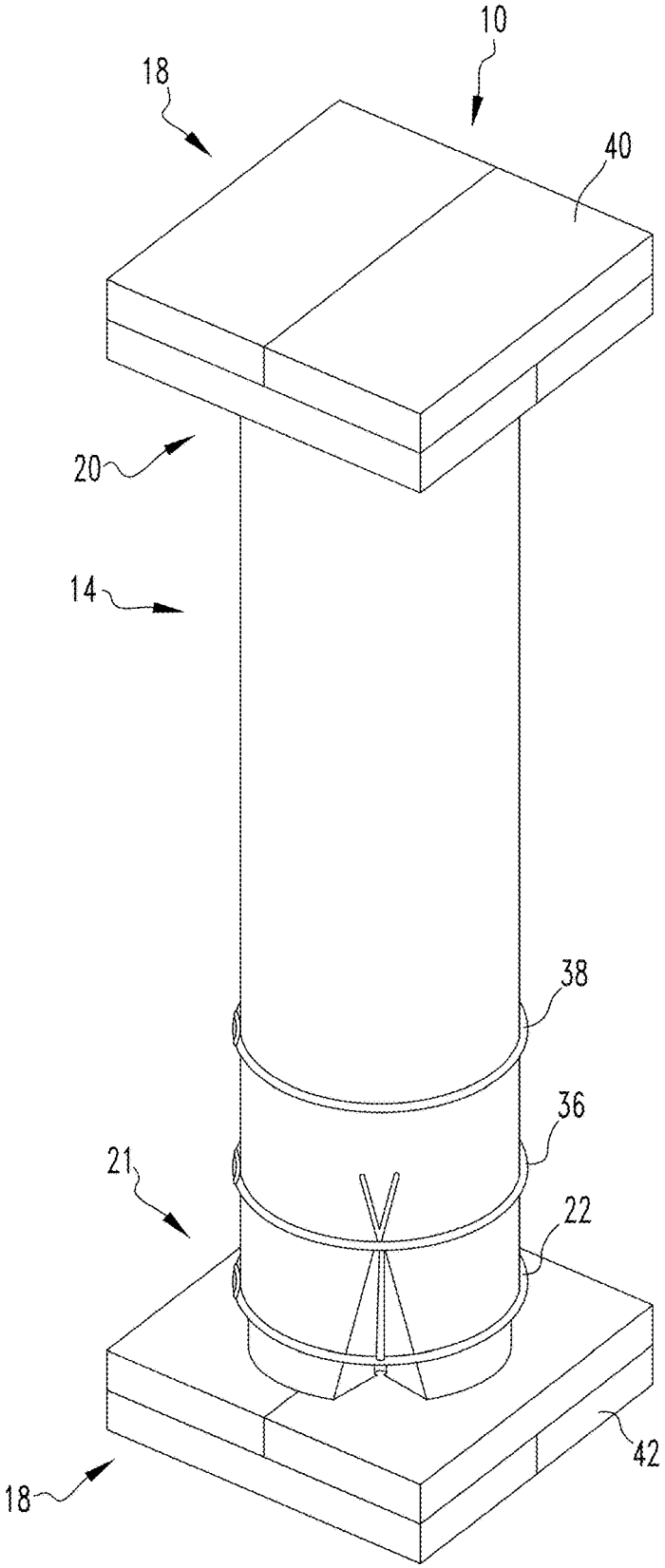
FIG. 1A is a perspective view of a prop of the present invention.

Referring now to the drawings wherein like reference numerals refer to similar or identical parts throughout the several views, and more specifically to FIG. 1-9 thereof, there is shown a prop 10 for supporting a roof 12. The prop 10 comprises a pole 14 that is positioned vertically relative to ground 16. The prop 10 comprises a tensioner 18 placed at a top of the pole 14 in between the pole 14 on the roof 12 to pretension the pole 14 with respect to the roof 12. The prop 10 comprises a ring 22 wrapped about the pole 14 and welded together so failure of the pole 14 under load from the roof 12 is a function of the weld 24.

The pole 14 may have cuts 26 in it in proximity to one end of the pole 14 forming a part of the reduced cross-sectional area 28 in relation to an uncut portion 30 of the pole 14. The ring 22 may be placed about the cuts 26. The ring 22 may be spot welded together about the pole 14. The prop 10 may include a second ring 36 and a third ring 38, each wrapped about the pole 14. The second ring 36 may be spot welded or solid welded together about the pole 14. The pole 14 may be made of wood. The tensioner 18 may be a head board 40. The prop 10 may include a baseboard position on the ground 16 and on which the pole 14 extends vertically upwards. The pole 14 may have a buckling stress to compressive strength ratio of about 0.45. The pole 14 may have a thin wedge dimension of about 1.25 inches. The pole 14 may have a thick wedge to cut length ratio of about 0.3. The ring 22 may be made of steel wire wrapped about the pole 14, with a weld 24 of about 0.5 to 1.5 inches in length adjacent a first end and a second end of the wire. The second and third rings 36, 38 are positioned on the pole 14 above the ring 22 and have solid welds 34, and the ring 22 has a spot weld 32. The ring 22 may be located between 1 and 2 inches above the bottom 21 of the pole, the middle or second ring 36 located 4 times the distance from the bottom 21 of the pole as the distance from the bottom 21 of the pole to the first ring, and the upper or third ring 38 located twice the distance from the bottom 21 of the pole as the distance from the bottom 21 of the pole to the middle ring. The ends of the cuts 26 measured from the bottom 21 of the pole parallel to the pole axis falls between the middle and upper rings.

The present invention pertains to a method for supporting a roof 12. The method comprises the steps of positioning a pole 14 of a prop 10 vertically relative to ground 16. The prop 10 comprises a ring 22 wrapped about the pole 14 and welded together so failure of the pole 14 under load from the roof 12 is a function of the weld 24. There is the step of positioning a tensioner 18 at a top 20 of the pole 14 in between the pole 14 on the roof 12 to pretension the pole 14 with respect to the roof 12.

The present invention pertains to a method for producing a prop 10 for supporting a roof 12. The method comprises the steps of placing a metal ring 22 about a wooden pole 14. There is the step of spot welding the ring 22 in place about the pole 14.

Figure 1B:
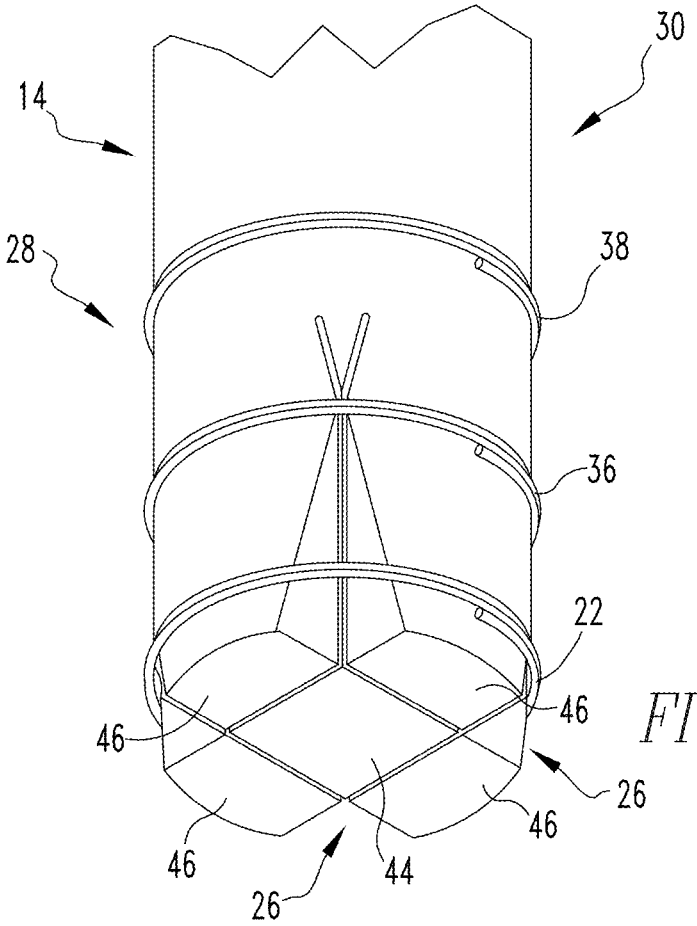
FIG. 1B shows wedge cuts and rings at the bottom of a pole of the prop.
Figure 1C:
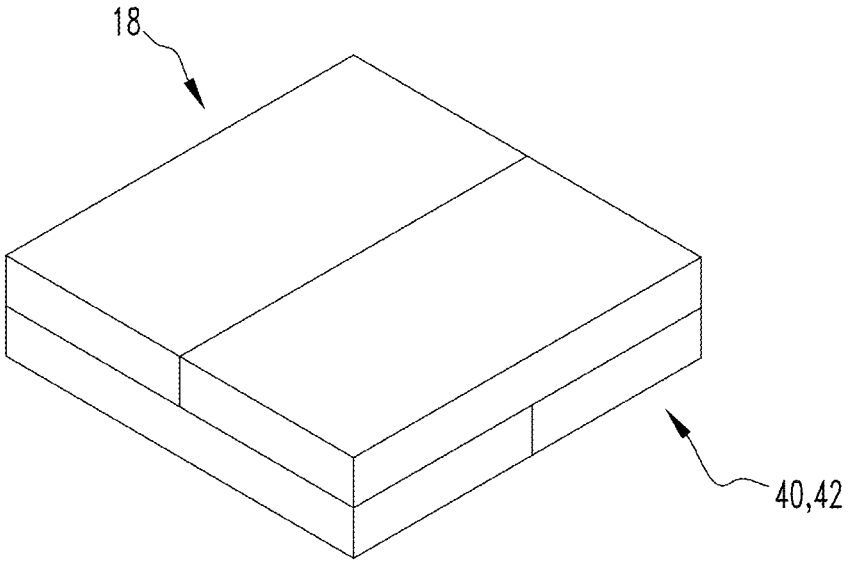
FIG. 1C shows a head/base board.
Figure 2A:
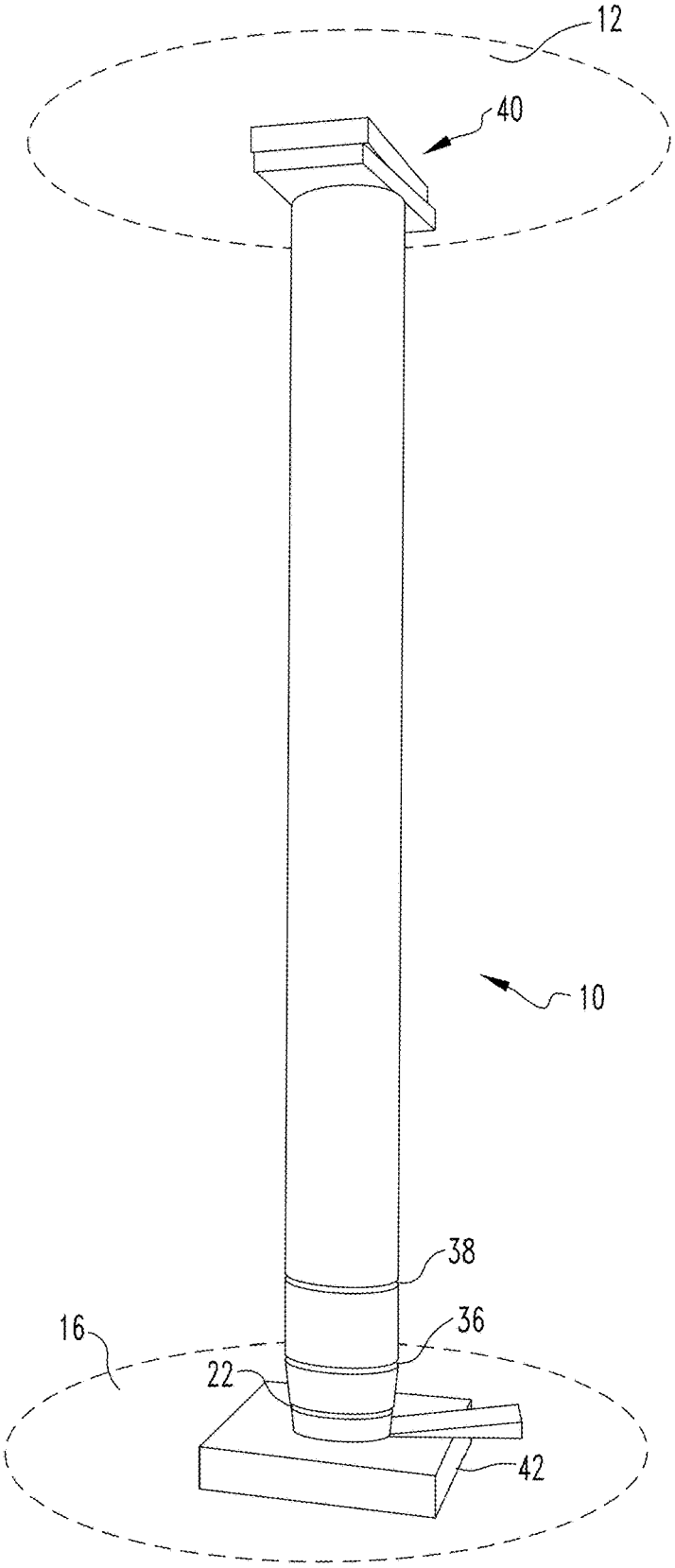
FIGS. 2A-2C show in sequence a brushing failure mechanism of the pole.
Figure 2B:
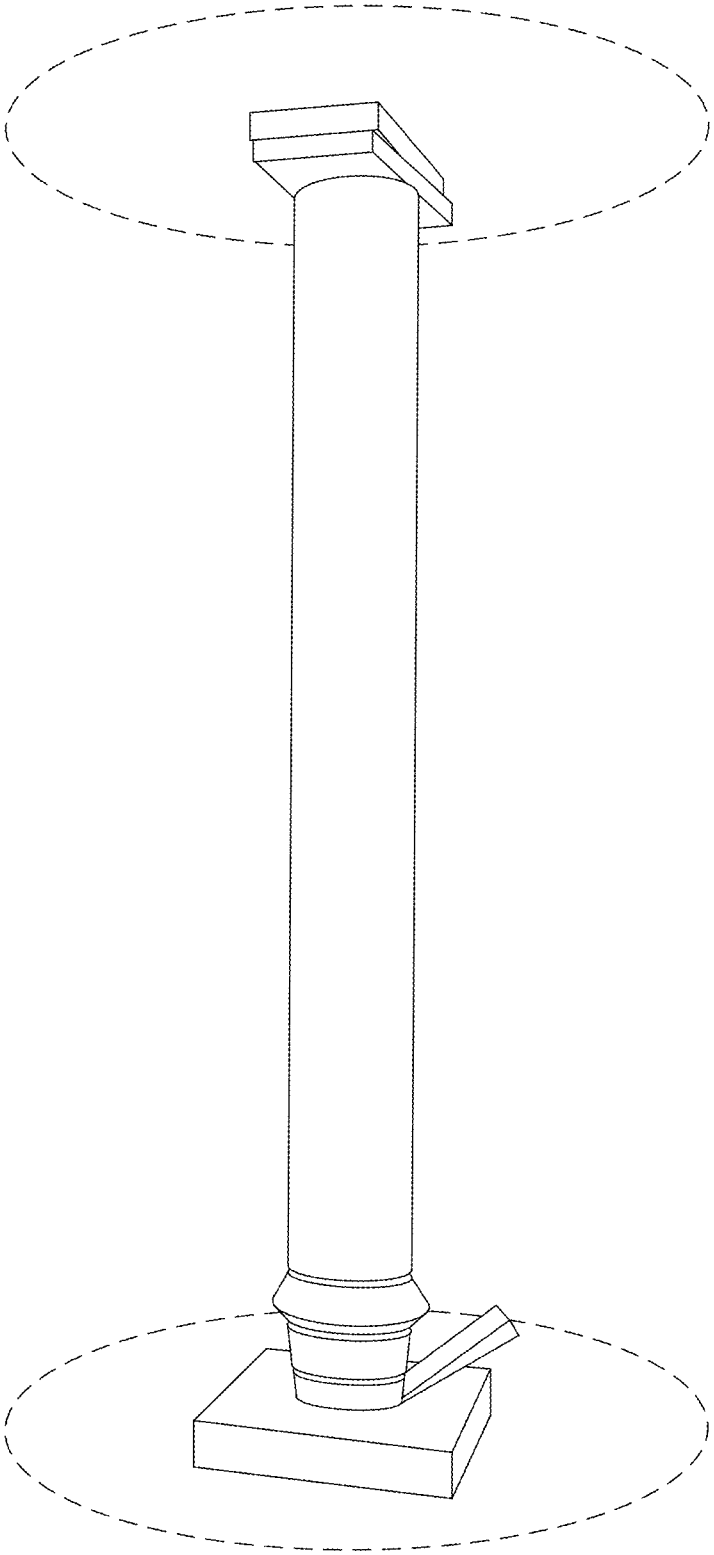
Figure 2C:
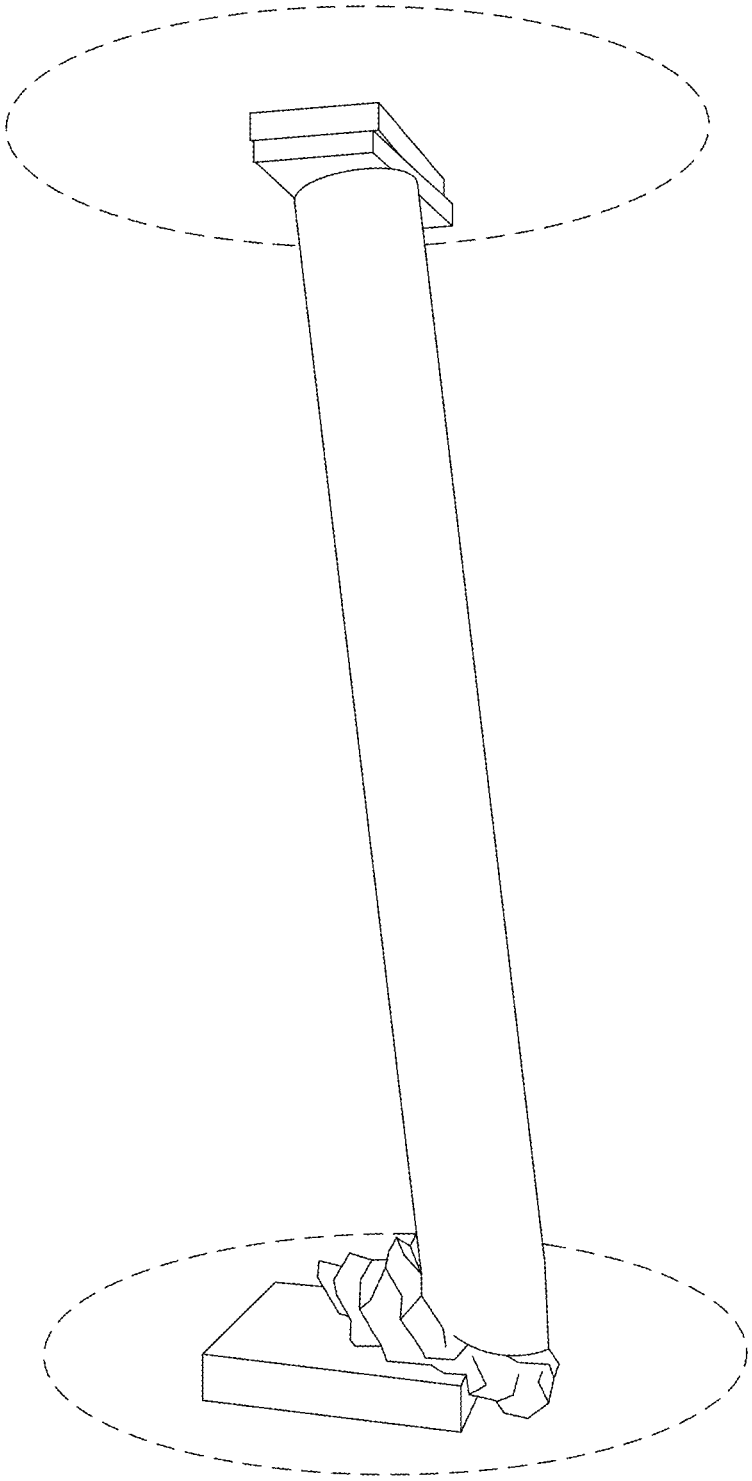
Figure 3A:
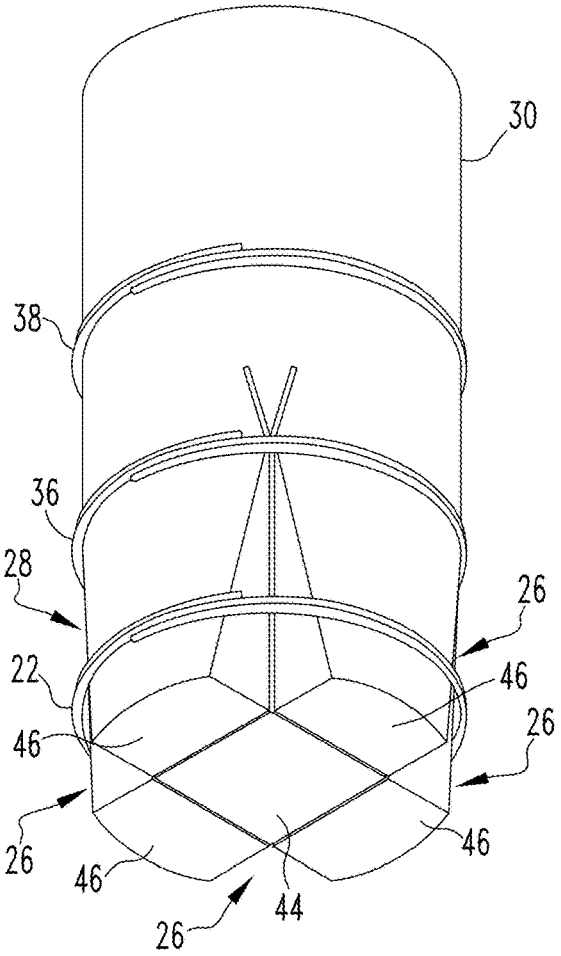
FIG. 3A shows wedge cuts and rings at the bottom of a pole of the prop.
Figure 3B:
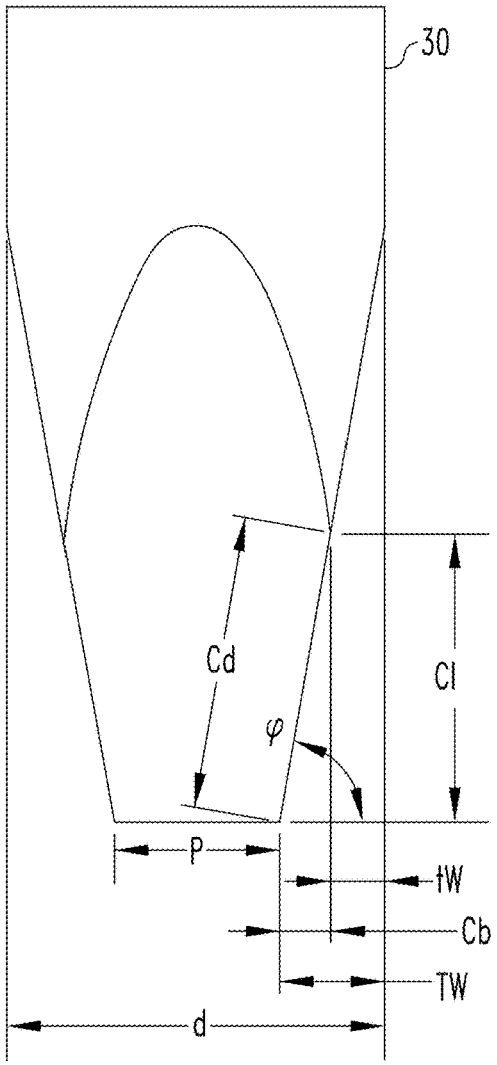
FIG. 3B shows the wedge prop components and standardized measurements.

In the operation of the invention, the prop 10 has three parts: a head board 40, a base board 42, and the pole 14 (see FIGS. 1A-1C). The head and base board 42 can be manufactured from any type of material, in this case mixed hardwoods, and rely on a crisscrossing pattern for strength. Multiple layers can be used for additional strengthening to prevent premature breaking and to create a stable area for the diffusing of force on the mine roof or floor. Multiple sizes of head and base board 42 can be manufactured depending on the mine roof conditions. Poor mine conditions may require a three-layer base or head board 40 to prevent punching of the prop 10 through the mine roof or floor, while good conditions could require a two-layer base or head board 40. When installed the base board 42 is placed on the ground 16 in the location that the prop 10 is to be set. The pole 14 is then stood vertically on the base board 42. The head board 40 is placed on top 20 of the pole 14 and the entire prop 10 is tensioned in place by driving wedges between the mine roof and the head board 40 or by placement of a pre-tensioning device. The primary portion of the support performance of the prop 10 comes from the pole 14. The Wedge Prop 10 consists of a timber pole 14 with a series of cuts 26 in one end forming a pod 44 of reduced cross-sectional area 28 in relation to the uncut portion 30 of the pole 14, as shown in FIG. 1B. For each side of the pod 44 there exists a paired wedge 46. A set of confinement rings are placed around the series of cuts 26.

The ability of the Wedge Prop 10 to accept ground 16 movement and provide a yielding roof support is due to the yielding failure mechanism known as, "Brushing." A timber pole 14 with no reduction in cross-sectional area will undergo failure due to buckling, where the pole 14 will snap in the center of the length due to the shape of the support under load. The series of cuts 26 in the Wedge Prop 10 allows for material failure, or crushing of the wood, before stresses within the pole 14 body would cause buckling. The brushing mechanism takes place when the timber pole 14 is under load. The central pod 44 is driven downwards into the base allowing the outer wedges 46 to drive upwards, a stage of loading known as, "Wedge Drive." The confinement rings provide resistance to the wedge's expansion due to the tapered nature of the central pod 44. As the tapered end of the pole 14 is revealed, the reduced cross-sectional area 28 provides an increase in stress concentration and will cause the wood to begin to crush. At this point the pole 14 will continue to crush and brush over itself (See FIGS. 2A-2C).

Previous Wedge Prop 10 designs have no specifications as to cut patterns or strength of confinement rings and often still fail due to buckling, because the cut pattern and confinement rings do not provide enough reduction in load capacity. An improved cut design and proper strength of confinement rings improves the success rate of the support and helps overcome additional difficulties, such as knots in the timber pole 14, which can act as stress risers, leading to failure.

The advantageous design of the newly manufactured Wedge Prop 10 consists of a cut pattern specifically developed for the timber pole 14 wood species and a set of confinement rings varying in strength due to different types of failure mechanisms. See FIGS. 3A and 3B for a reference to components and measurements of the Wedge Prop 10. The yielding end of the timber pole 14 is defined by four cuts 26 made at right angles to one another forming a central pod 44. The cuts 26 are made on an angle sloping from the pole 14 length's axis to the outer surface of the pole 14. The sloping cuts 26 will create a tapered end to the timber pole 14. The remaining material between the cut and the outer surface of the pole 14 is known as the wedge 46.

The maximum length of the pole 14 is an important consideration as the longer the pole body becomes the more easily buckling can occur. The maximum length is calculated by using a Buckling Stress to Compressive Strength Ratio. The buckling stress for different length poles of a given diameter is calculated and using the material compressive strength the ratio can be found. A Buckling Stress to Compressive Strength Ratio near 0.45 for dry wood conditions is found to provide the most reliable estimation of the longest length a pole can be manufactured for a given diameter. The dry wood conditions are prioritized in this ratio as dry wood is more likely to buckle, so it is more important to consider when looking at buckling stress.

Figure 4:
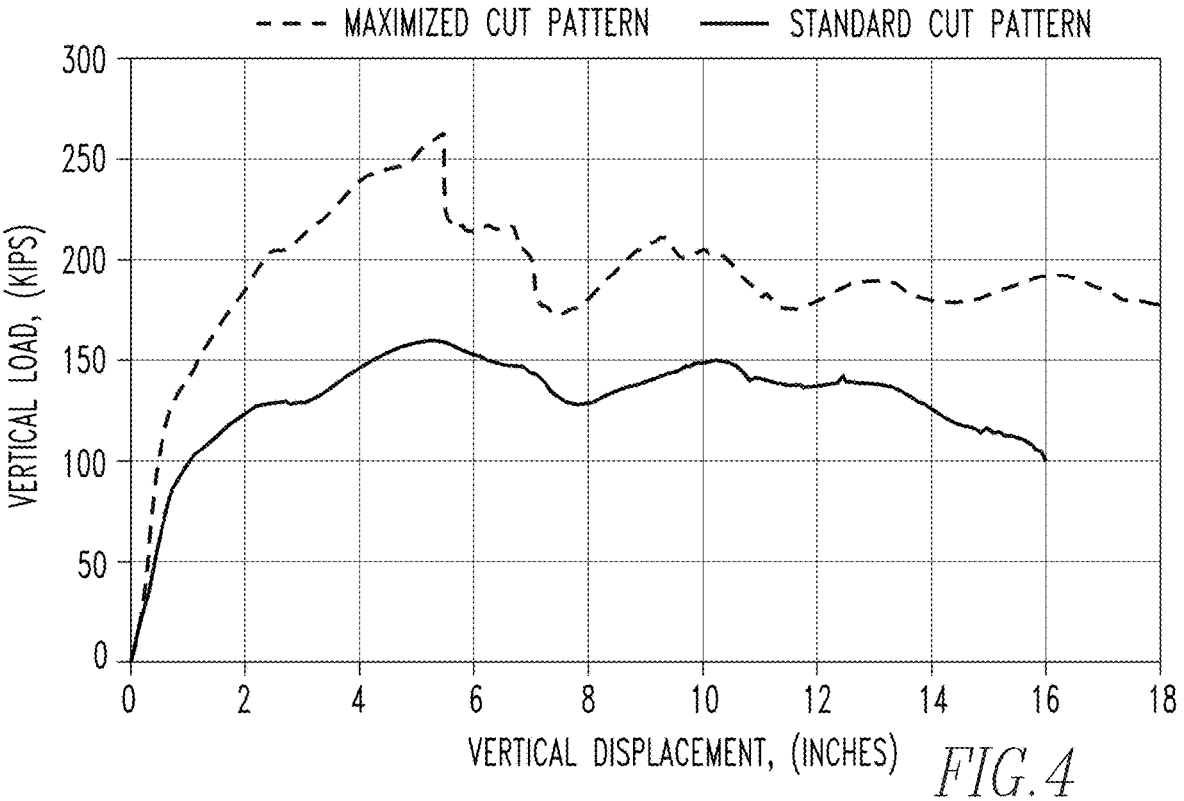
FIG. 4 is a graph of the maximized cut pattern versus standard cut pattern with no confinement ring alteration of the prop.

A standardized system of measurements was created to apply to the wedge cut design. The measurements are derived from the controllable manufacturing variables of the timber pole 14, which are primarily the pole 14 diameter, pod size, cut angle, and cut length. Through a series of calculations and tests, two parent dimensions can be applied to a pole 14 of a given diameter to maximize the support capacity, while providing a controlled, yielding response. The parent dimensions are the Thin Wedge (tw) and the Thick Wedge to Cut Length (Cl) ratio. The Thin Wedge dimension is the measurement perpendicular to the pole 14 length's axis from the end of the cut to the outer surface of the pole 14. The Thick Wedge to Cut Length ratio is the ratio of measurement perpendicular to the pole 14 length's axis from the cut entry to the outer surface of the pole 14 (Thick Wedge) to the measurement from the base of the pole 14 to the end of the cut parallel to pole 14 length's axis (Cut Length). By applying a value of 1.25 inches to the Thin Wedge dimension and a value of 0.3 to the Thick Wedge to Cut Length ratio, the support capacity of the timber pole 14 can be maximized. FIG. 4 depicts the old cut pattern compared to the maximized cut pattern without the varying strength rings applied.

Although the support capacity in FIG. 4 has been maximized for a yielding failure, the result still presents an issue of failure to maintain a peak loading capacity. Strain softening (lessening of support capacity over deformation) behavior can potentially create hazardous conditions in the right environment, due to the loss of support capacity, which is why a change to the confinement rings in addition to, the cut pattern is necessary.

Figure 5:
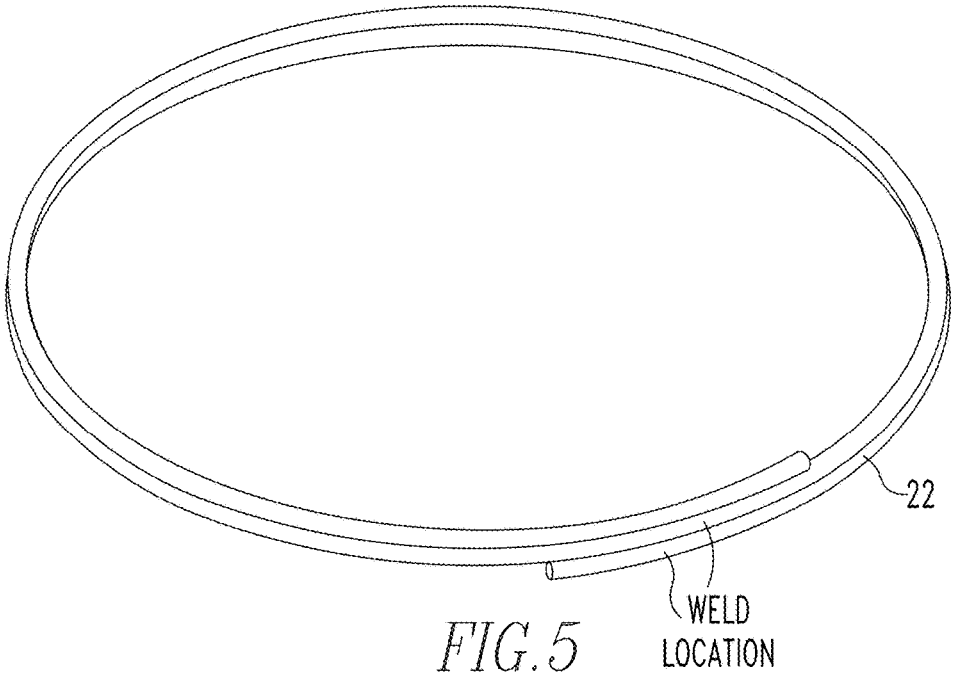
FIG. 5 shows a confinement ring.
Figure 6A:
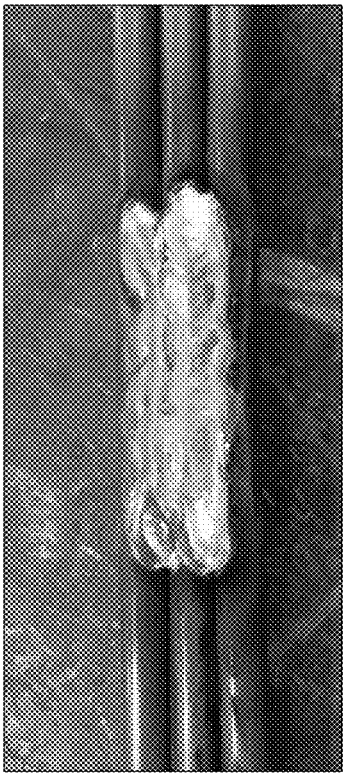
FIG. 6A shows a solid weld in regard to a confinement ring before testing.
Figure 6B:
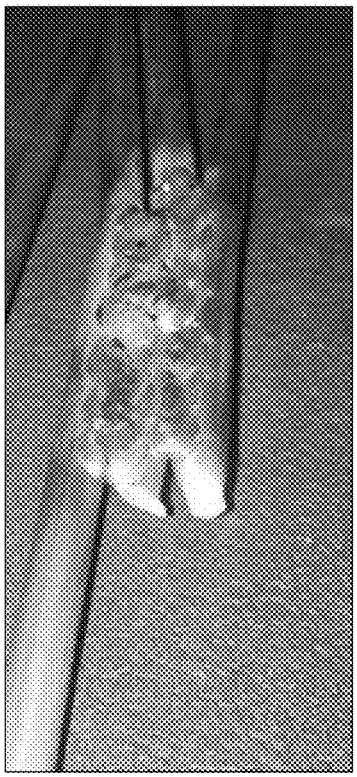
FIG. 6B shows a solid weld of FIG. 6A after testing.
Figure 6C:
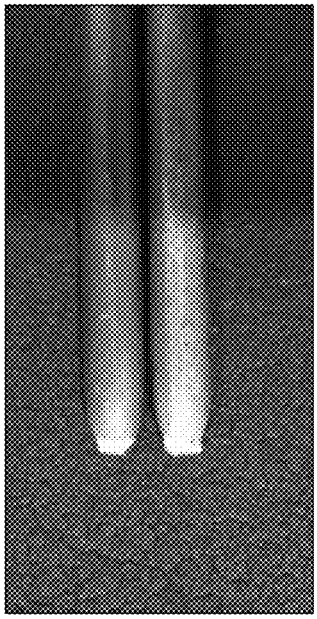
FIG. 6C shows a solid weld wire after testing.

The confinement rings are the true precision control of the yielding performance of the Wedge Prop 10. The release of stored energy in the timber pole 14 is directly related to the confinement strength of the ring 22, as the rings will either allow or disallowed the wedges to drive along the tapered pole 14 bottom. The confinement ring is made of a ¼" diameter, mild steel wire, in rod form, bent slightly over 720 degrees to fit around the timber pole's outer diameter. The ends of the wire are then pinched to the continuous central layer formed and a weld 24 is made. The wire is pinched together to create a coil where each coiled layer is touching one another, allowing for easy handling of the welded ring 22. The welds are made towards the ends of the wire to prevent the wire from jutting away from the prop 10 body and creating any working hazards. The standard, solid weld 34 is typically 0.5 to 1.5 inches in length and creates a block or two beads of weld 24 over the wire. Previous Wedge Prop 10 results often show a release in energy (drop in support capacity) due to a confinement ring 22 abruptly breaking. The confinement ring 22 will begin to stretch and when enough expansion (wedge drive) occurs, the ring 22 will snap, undergoing tensile failure. FIG. 5 depicts a basic ring 22 with no weld applied. FIGS. 6A-6C show photos of a standard, solid weld 34 before and after failure, where the solid weld 34 is still present but the wire tips have snapped or stretched apart, as shown in FIG. 6C. Note that the wire tips after failure are pointed, reinforcing the tensile or stretching failure mechanism.

In the design process, it is easy to believe that strengthening the confinement ring 22 is necessary to overcome the ring 22 breaking and the loss in support capacity. This is also where the counterintuitive decision was made to develop a ring 22 that was weaker and would fail due to a different mechanism.

Figure 7C:
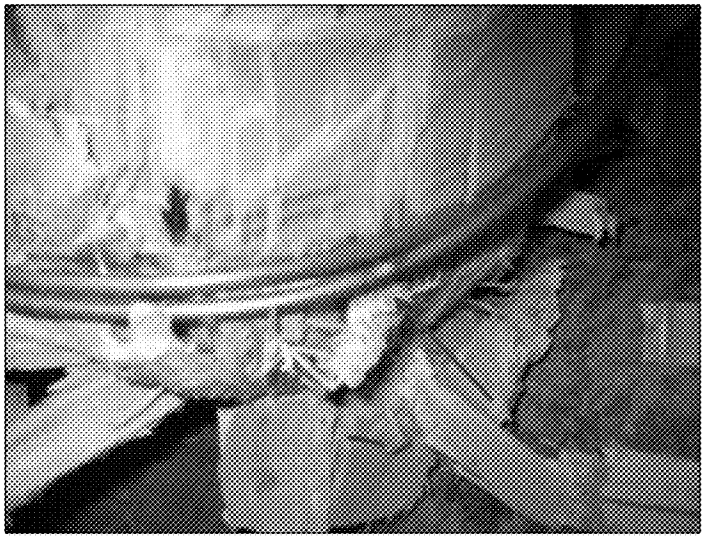
FIG. 7C shows a spot weld of FIG. 7A after testing.
Figure 7B:
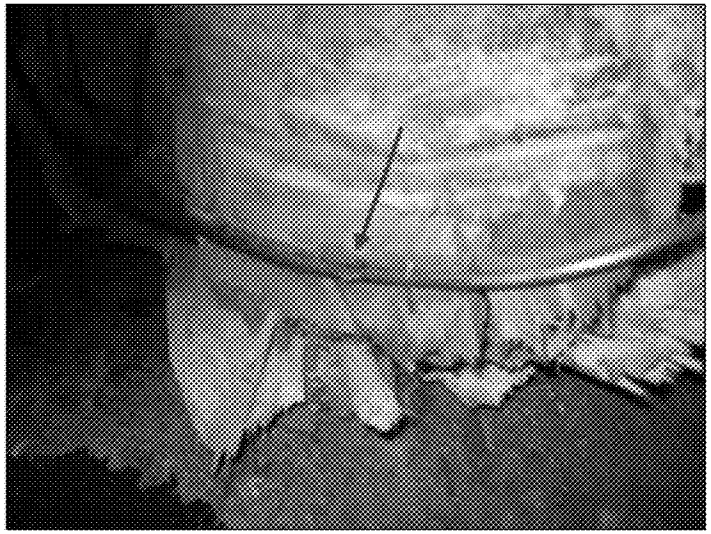
FIG. 7B shows a spot weld of FIG. 7A after testing.
Figure 7A:
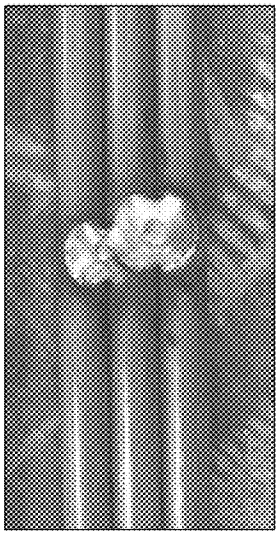
FIG. 7A shows a spot weld in regard to a confinement ring before testing.
Figure 8:
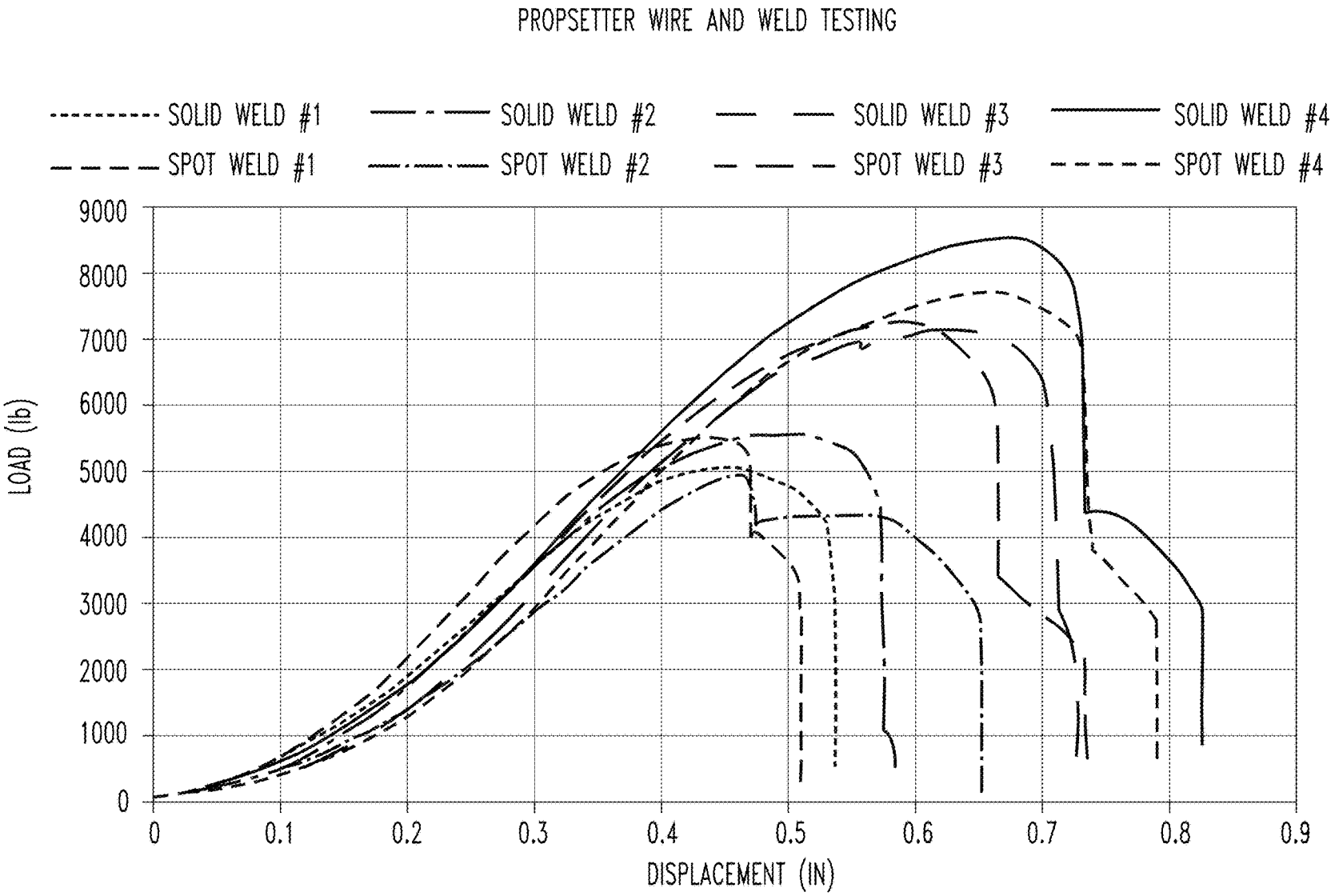
FIG. 8 is a graph showing solid weld versus spot weld wire pole tests results.

The newly developed confinement ring 22 is made of mild steel wire in rod form and bent in the same manner as the older version, although it features a spot weld 32 rather than a solid weld 34. Compared to the solid weld 34, the spot weld 32 consists of only two small dots of weld material, usually ¼ inch or less in length, stacked on top of one another. By making a spot weld 32, the failure mechanism of the ring 22 changes from a tensile failure of the wire to a mechanical detachment of the weld 24 from the wire. The weld 24 detachment decreases the ring 22 strength by nearly 2400 pounds of force. FIGS. 7A-7C show photos of before and after the spot weld 32 testing, where FIG. 7C shows the ring 22 intact but its spot weld disintegrated, while FIG. 8 shows the results of solid weld 34 and spot weld 32 wire pull tests, to measure the strength of each.

Figure 9:
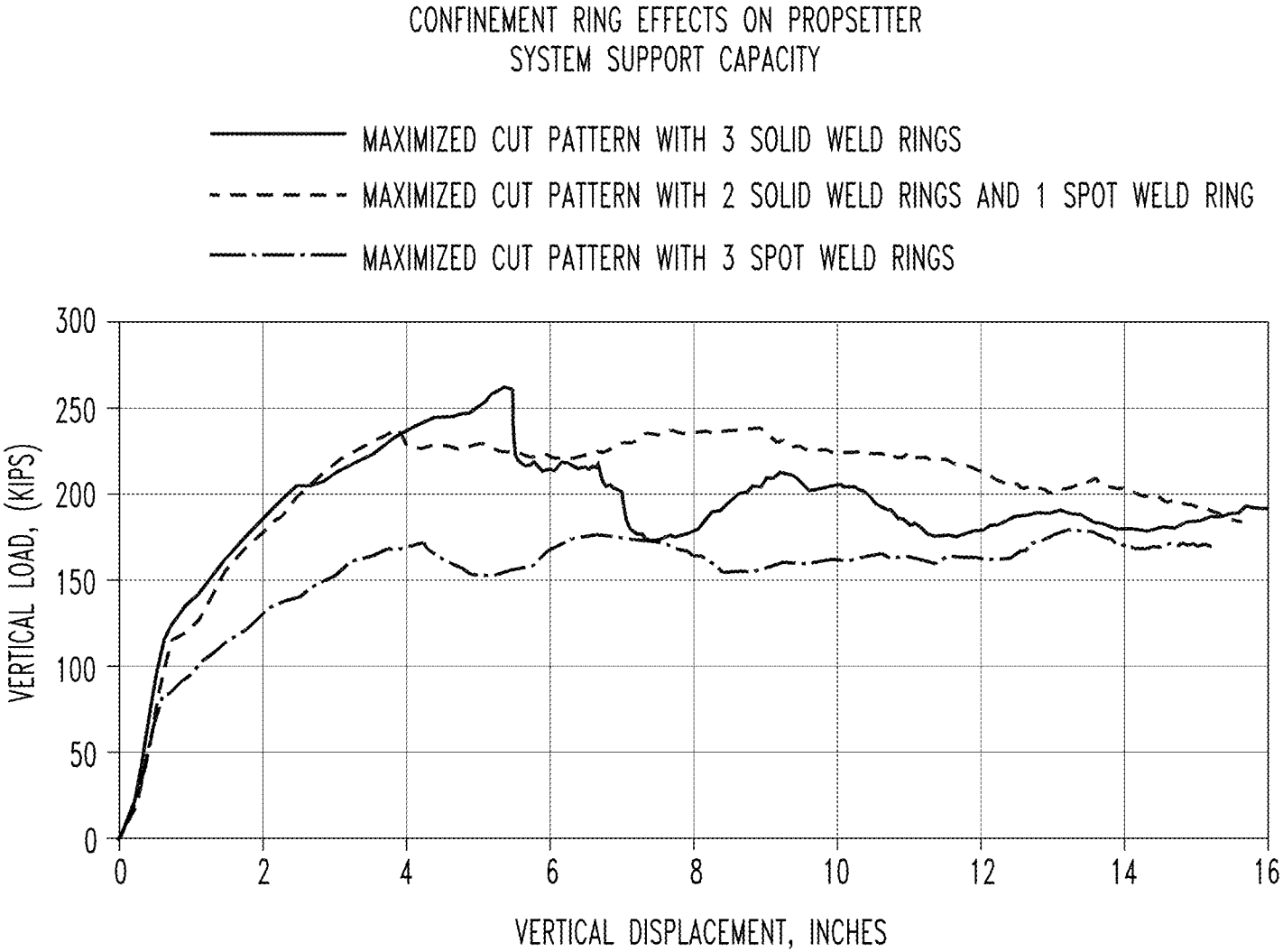
FIG. 9 is a graph showing the effects of confinement ring failure mechanism.

The set of three confinement rings on the wedge prop 10 can consist of all solid welds 34 (increase support capacity), all spot welds 32 (reduce support capacity), or a combination of the two types of confinement rings to achieve a balance of maximized and sustained support capacity. The final pattern of combination used for a balance approached, was a solid weld 34 on the upper two rings (the second ring 36 and the third ring 38) and a spot weld 32 on the lower most ring 22. A spot weld 32 was used on the lower most ring 22, because it will experience the most expansive force and needs to release by a mechanism other than tensile failure. FIG. 9 gives a comparison of the difference between the three combinations of confinement ring 22 types. The location of the confinement rings can vary depending on desired performance, but the general location of the ring 22 will provide the correct confining forces to allow for the wedge drive to occur during the brushing process. Generally, the best positions for the rings are located at or near the following locations: lower most ring 22 located between 1 and 2 inches above the bottom 21 of the pole 14, the middle or second ring 36 located 4 times the distance from the bottom 21 of the pole as the distance from the bottom 21 of the pole to the ring 22, and the upper or third ring 38 located twice the distance from the bottom 21 of the pole as the distance from the bottom 21 of the pole to the second ring 36. Adjustments to this general rule are generally best done through physical prop 10 testing. It is important however, that the end of the cut, measured form the bottom 21 of the pole parallel to the pole axis, falls between the middle (second) and upper (third) rings. This will allow for the wedge drive to occur without cracks forming up the pole body from the end of the cuts 26.

An example of developing a 100-ton capacity prop 10 with the aforementioned technologies is described as follows:

The buckling stress for a number of different diameter and length poles is calculated for both green and dry mechanical properties of yellow poplar using the American Forest and Paper Association's equation for buckling stress of a round, wooden compression member. The stresses are then converted to a load to see which diameter will meet the 100-ton capacity criteria. The load capacity is based on the load value for the green wood. The green wood value is used because dry wood is typically stronger, although it tends to buckle more easily, and in the worst-case scenario a green Propsetter would be used, it would still meet the capacity rating. While the buckling stress of the poles are being calculated, the Buckling Stress to Compressive Strength Ratio is being simultaneously calculated. These calculations would lead to showing an 11.5-inch pole, 132 inches long would be able to carry a green load of 138 tons and has a dry Buckling Stress to Compressive Strength Ratio of 0.49. Although this size pole may be able to carry 138 tons of load, the capacity is derated to the desired 100 tons to provide a safety factor.

After the pole body dimensions are calculated, the cut design can then be established. As the pole diameter has been established, the two parent dimensions can be applied. Using a value of 1.25 inches for the Thin Wedge dimension and a value of 0.3 for the Thick Wedge to Cut Length ratio the manufacturing dimension can be calculated, leading to a square pod with the side length of 5 inches and a cut that is 11.5 inches deep at a 10-degree angle sloping from the pole's long axis towards the outer surface of the pole. At this point the rings will be placed on the cut portion of the pole and if the lower most ring 22 is to be placed 2 inches from the bottom 21 of the pole, the middle ring 36 would be placed 8 inches and the upper ring 38 placed 16 inches from the pole bottom 21. The cut depth measured parallel to the pole's long axis is 11.3 inches (calculated using trigonometry), placing the end of the cut between the upper two rings. The lower ring 22 would consist of a spot weld 32, while the upper two rings 36, 38 would utilize a solid weld 34.

Figure 10:
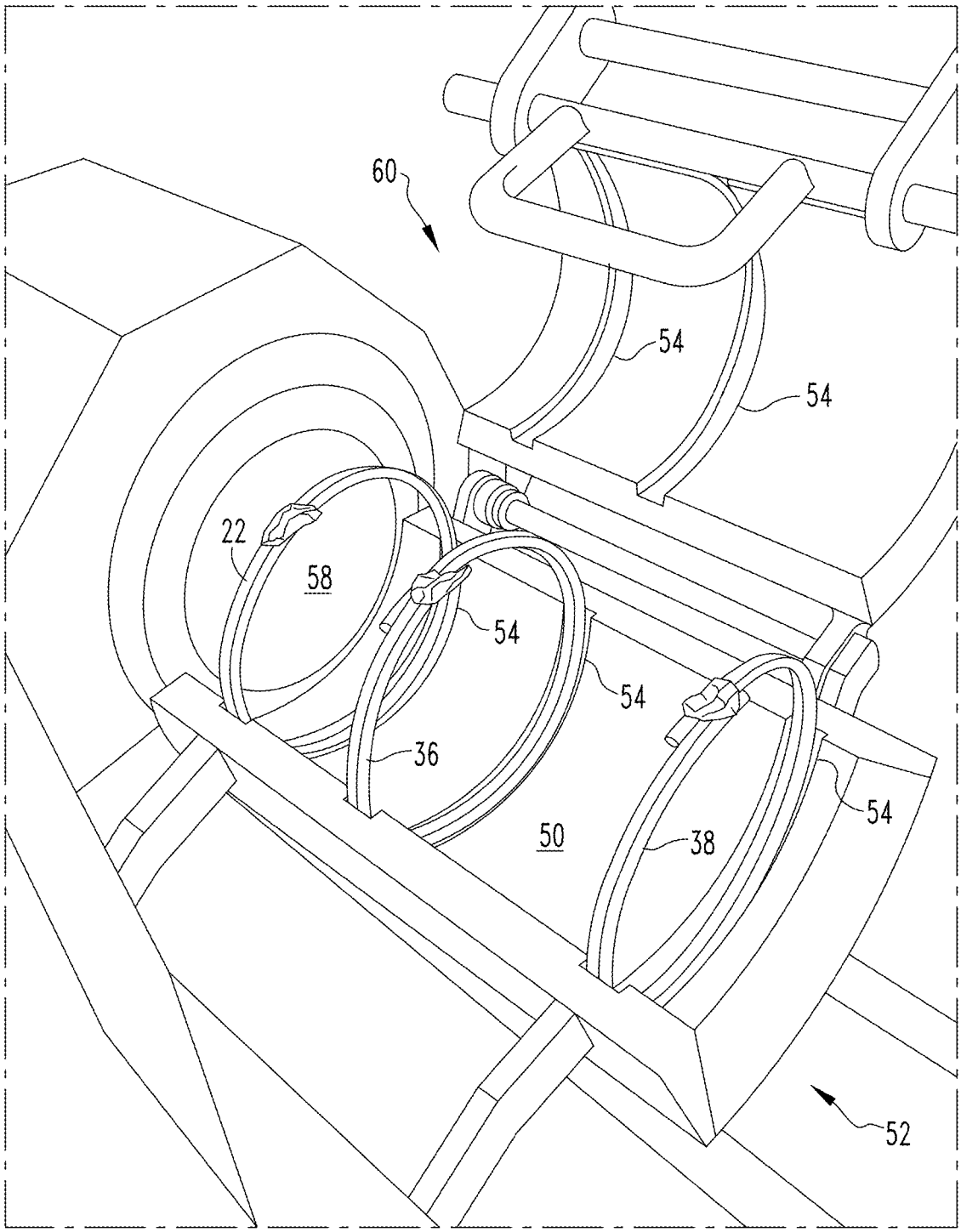
FIG. 10 shows a ring press.

Manufacturing of the pole 14 consists of a number of steps. First a log is debarked and rounded to the desired dimension, in this case 11.5 inches. The rounded pole is then laid down, so the long axis is horizontal. The pole is locked in place by a series of clamps so the cut pattern can be applied. A saw that's cutting axis is parallel to the pole's long axis is then placed at what will be the bottom 21 of the pole. The saw is angled sloping away from the long axis of the pole and set half of the pod 44 side length's distance off center. Finally, the cut depth of the saw is set. The saw makes the first cut and the pole is then rotated 90 degrees. The saw makes a second cut and the process repeats for a total of four cuts 26 to create the four sides of the square pod 44. The cut pole is then removed from the saw area and again laid so the long axis is horizontal. The rings are placed onto the pole by have the pole pressed into a form 50 of a mold 52 of a ring press 60 that holds the rings in the desired positions measured from the bottom 21 of the pole. See FIG. 10. The form 50 is tapered, so as the cut end of the pole is pressed into the mold 52, the wedges 46 are squeezed inwards letting the pole slip through the rings being held in place. The rings are positioned in and held in place in recesses 54 in the mold 52. The inner diameter of the hollow closed cylindrical mold 52 is ⅛" smaller than the diameter of the reduced cross-sectional area 28 of the pole 14. The third ring 38 has the same diameter as the mold 52, when the third ring 38 is seated in its recess 44. The second ring 36 has a diameter ⅛" less than the diameter of the mold 52, when the second ring 36 is seated in its recess 54. The ring 22 has a diameter that is ¼" less than the diameter of the mold, when the ring 22 is seated in its recess 54. Because of the cuts, the wedges 46 are squeezed inwards as the bottom 21 of the pole 14 is pushed through the rings in the mold 52 until it hits a stop 58. When the pole 14 is removed from the mold 52, the wedges 46 expand, squeezing against the rings which all have a diameter less than the untensioned diameter of the bottom 21. In this way, the rings are fixedly positioned in place to the pole 14. The pole is removed with the rings in place and staples are placed over the rings so they cannot move out of position. FIG. 10 provides an example of the ring press 60, that is open.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A prop for supporting a roof comprising:

a wood pole that is positioned vertically relative to ground;

a tensioner positioned at a top of the pole in between the pole and the roof to pretension the pole with respect to the roof to hold the pole in place; and a metal ring wrapped about the pole and welded together with a spot weld so failure of the pole under load from the roof is a function of the spot weld by mechanical detachment of the weld before tensile or stretching failure of the metal material of the ring.

2. The prop of claim 1 wherein the pole has cuts in proximity to one end of the pole forming a part of a reduced cross-sectional area in relation to an uncut portion of the pole.

3. The prop of claim 2 wherein the ring is placed around the cuts.

4. The prop of claim 3 wherein the cuts form a pattern which provide a brushing failure mechanism.

5. The prop of claim 4 which has a buckling stress to compressive strength ratio of about 0.45.

6. The prop of claim 5 wherein the pole has a thin wedge dimension of about 1.25 inches, and the pole has a thick wedge to cut length ratio of about 0.3.

7. The prop of claim 6 wherein the ring is made of steel wire which is wrapped about the pole, spot weld is about 0.5 to 1.5 inches in length adjacent a first end and a second end of the wire to hold the first end and the second end together.

8. The prop of claim 7 including a second ring and a third ring, each wrapped around the pole, with the ring and the second ring and the third ring spaced from one another in an axial direction of a length of the pole.

9. The prop of claim 8 wherein the second and third rings are positioned on the pole above the ring and have solid welds.

10. The prop of claim 9 wherein the ring is located between 1 and 2 inches above the bottom of the pole, the second ring located 4 times a distance from the bottom of the pole as a distance from the bottom of the pole to the ring, and the third ring is located twice the distance from the bottom of the pole as the distance from the bottom of the pole to the second ring; the end of the cuts measured from the bottom of the pole parallel to the pole axis, falls between the second and third rings.

11. The prop of claim 10 wherein the tensioner is a head board positioned perpendicular to the pole.

12. The prop of claim 11 including a baseboard position on the ground and on which the pole extends vertically upwards.

13. A prop for supporting a roof comprising:

a wood pole that is positioned vertically relative to ground;

a tensioner positioned at a top of the pole in between the pole and the roof to pretension the pole with respect to the roof to hold the pole in a metal ring wrapped about the pole and welded together with a spot weld so failure of the pole under load from the roof is a function of the spot weld by mechanical detachment of the weld before tensile or stretching failure of the metal material of the ring; and the pole has a thin wedge dimension of about 1.25 inches, and the pole has a thick wedge to cut length ratio of about 0.3.

14. A prop for supporting a roof comprising:

a pole that is positioned vertically relative to ground;

tensioner positioned at a top of the pole in between the pole and the roof to pretension the pole with respect to the roof to hold the pole in place; and a plurality of metal rings wrapped around the pole, with each of the plurality of rings welded together with different types of welds, including a spot weld and a solid weld, allowing for different types of ring failures, including at least one weld failing by mechanical detachment of the at least one weld before tensile or stretching failure of the metal material of the respective ring.

15. A method for supporting a roof comprising the steps of:

positioning a wood pole of a prop vertically relative to ground, the prop comprises a metal ring wrapped about the pole and spot welded together so failure of the pole under load from the roof is a function of the spot weld by mechanical detachment of the spot weld before tensile or stretching failure of the metal material of the ring; and positioning a tensioner at a top of the pole in between the pole and the roof to pretension the pole with respect to the roof.

16. A method for producing a prop for supporting a roof comprising the steps of:

placing a metal ring about a wooden pole; and spot welding the ring in place about the pole so failure of the pole under load from the roof is a function of the spot weld by mechanical detachment of the spot weld before tensile or stretching failure of the metal material of the ring.

* * * * *